US007857292B2

(12) United States Patent
Esposito

(10) Patent No.: US 7,857,292 B2
(45) Date of Patent: Dec. 28, 2010

(54) FENCE SYSTEM WITH INSECT BARRIER

(76) Inventor: Rosario Esposito, 53401 Schoenherr, Shelby Township, MI (US) 48315

( * ) Notice: Subject to any disclaimer, the term of this patent is extended or adjusted under 35 U.S.C. 154(b) by 0 days.

(21) Appl. No.: 12/128,317

(22) Filed: Aug. 12, 2008

(65) Prior Publication Data

US 2009/0121206 A1 May 14, 2009

Related U.S. Application Data

(63) Continuation of application No. 10/971,989, filed on Oct. 22, 2004, now abandoned.

(51) Int. Cl.
*E04H 17/14* (2006.01)

(52) U.S. Cl. ..... 256/65.11; 256/22

(58) Field of Classification Search ..... 256/21, 256/22, 59, 65.11, 65.09, 65.02
See application file for complete search history.

(56) References Cited

U.S. PATENT DOCUMENTS

| | | | | |
|---|---|---|---|---|
| 16,419 | A * | 1/1857 | Wickersham | 256/70 |
| 2,919,113 | A * | 12/1959 | Cofield | 256/65.11 |
| 4,014,520 | A | 3/1977 | Walters | |
| 4,145,031 | A | 3/1979 | Baker, II | |
| 4,188,019 | A | 2/1980 | Meredith | |
| 4,498,660 | A | 2/1985 | Brema et al. | |
| 4,553,741 | A * | 11/1985 | Creasy et al. | 256/66 |
| 4,609,185 | A | 9/1986 | Prater et al. | |
| 4,898,365 | A | 2/1990 | Conner et al. | |
| 5,454,548 | A | 10/1995 | Moore | |
| 5,651,534 | A | 7/1997 | Yoder | |
| 5,713,171 | A | 2/1998 | Andres | |
| D422,715 | S * | 4/2000 | Chaney et al. | D25/38 |
| 6,299,142 | B1 | 10/2001 | Chaney et al. | |
| 6,305,671 | B1 | 10/2001 | Valentine | |
| 6,345,809 | B1 | 2/2002 | Bebendorf et al. | |
| 6,499,725 | B2 * | 12/2002 | Meis et al. | 256/65.03 |
| 6,523,807 | B2 | 2/2003 | Calverley | |
| 6,883,786 | B2 * | 4/2005 | Bebendorf | 256/19 |

* cited by examiner

*Primary Examiner*—Joshua T Kennedy
(74) *Attorney, Agent, or Firm*—Rader, Fishman & Grauer PLLC

(57) ABSTRACT

A fence system including a fence post and a rail inserted into and supported by the fence post. The rail being an elongated member having a channel or U-shaped cross section defined by a web member and parallel leg members attached to the web member. The rail is inserted into an aperture located in a sidewall of the post. The aperture having a shape or configuration that is substantially the same as the cross-sectional shape of the rail. Accordingly, any gaps between the opening or aperture in the post and the rail, once the rail is inserted into the post, are minimized.

6 Claims, 3 Drawing Sheets

10
12
14
16
18
20
22
24
26
28
30
32
34
36
38
40
42

FENCE SYSTEM WITH INSECT BARRIER

CROSS-REFERENCE TO RELATED APPLICATIONS

This Application is a Continuation of application Ser. No. 10/971,989 filed on Oct. 22, 2004.

BACKGROUND OF THE INVENTION

1. Field of the Invention

The present invention relates generally to a rail type fence system including a fence post and rails. More specifically, the invention is directed to a rail type fence system having a configuration that limits access to the interior of the fence post and rail components to prevent formation of insect nests.

2. Description of Related Art

Fences are almost as old as humanity. Over the years, fences of all types and kinds, from rock walls to barbed wire, were built with one of two purposes in mind, keep things in or keep them out. For instance, fences are used to keep livestock in a certain area or are placed around a particular area to prevent access thereto. Today, fences also provide a decorative touch or provide privacy.

One of the more common fence systems presently used is a fence post and rail combination, wherein the fence posts are placed at spaced intervals. Horizontal rails are placed between the fence posts. One example of a fence post and rail combination is the standard split rail fence seen throughout much of rural America typically used to contain livestock. In many instances, attached to the rails are fence elements or pickets forming what we refer to today as a picket fence.

Like many of our products today, fences are manufactured and sold as a component system, including a plurality of preformed fence posts as well as a plurality of rails designed to fit, connect, or interlock to the fence posts. Typically, these fence systems utilize a tubular fence posts made of metal or plastic having a plurality of shaped apertures located in the sidewalls thereof to receive the rails, including appropriate hardware to interlock the components together.

One example of such a fence system is illustrated in U.S. Pat. No. 5,651,534 to Yoder. Yoder teaches a plurality of hollow, extruded fence posts as well as a number of hollow, extruded fence rails. A pair of rectangular shaped openings located on opposed walls of the fence posts receive the rails of the fence system. As shown in Yoder, the rails have a rectangular shape with a closed cross section. Thus, the rails fit securely within the rectangular shaped apertures in the fence posts without leaving any appreciable gaps. A cap closes the upper end of the fence post and further prevents access to the hollow interior thereof.

Another example of a fence system is disclosed in U.S. Pat. No. 4,609,185 to Prater et al. Prater et al. discloses a fence post and rail configuration including tubular fence posts containing a plurality of apertures in the sidewalls thereof for receiving the rails. The rails are formed with a generally channel or U-shaped cross section formed of a web and sidewalls extending therefrom. Accordingly, when the rail is inserted into the tubular fence post, a gap or opening exists that extends between the lower edge or sides of the rectangular shaped aperture and the web of the rail. This gap or opening provides access to the interior of the hollow fence post.

One drawback of such a modular fence design using a rail having a channel or U-shaped cross section is that insects, particularly bees or hornets have access to the interior of the hollow fence post and often build nests within the fence posts.

This can be very problematic, especially when such fence systems are used around homes and recreation areas, particularly pools and playgrounds.

Accordingly, in an attempt to reduce the possibility of insect infestation, including the opportunity for insects to build nests within the hollow fence post, it is desirable to reduce the opportunity for insects to have access to the hollow interior of the fence posts by somehow closing the gap or opening.

FIGS. 4-5 illustrate a prior art design for closing the gap or opening. Specifically, a plurality of preformed plugs are inserted into the channel or U-shaped rail, between the sidewalls and up to the web member thereof. The plugs operate to form a seal that reduces access to the interior of the fence post. The plugs are formed in accordance with the specific size and configuration of the rail. Thus, a stock of variably sized plugs is necessary depending upon the design and parameters of the fence system. In addition, the cost of manufacturing and storing the plugs can make such a system too expensive for all but very small uses. Further, it should be taken into account that inserting a plug in each rail at every fence post and rail junction is a time-consuming and laborious procedure, which, for large amounts of fencing, can be cost prohibitive.

From the above, it can be appreciated that modular fence systems are not fully optimized to provide a simpler, less costly fence system that reduces the opportunity for insect infestation in the fence components, particularly the fence posts. Therefore, what is needed is a fence post and rail system that fits together without any appreciable gap or opening between the fence post and rail and thereby reduces the opportunity for insect infestation within the fence post.

BRIEF SUMMARY OF THE INVENTION

According to the preferred embodiment of the present invention, there is provided a fence system including a fence post and a rail for insertion into an aperture in the fence post. The rail has a channel or U-shaped cross section that results in one side being open. The aperture in the fence post is configured similar to the cross section of the rail and includes an upstanding portion or tab. The upstanding portion or tab is sized such that it fits within the channel or interior of the U-shaped cross section to block access to the interior of the fence post. Thus, the present invention is capable of successfully incorporating the benefits of a fence system with an integrated insect barrier without the need for additional plugs or stop members.

It is an object of the present invention to provide a fence system for use with rails having generally a channel or U-shaped cross section. The fence post includes an aperture having an upstanding portion or tab that fits within the channel. Wherein the rails fit snugly into the aperture in the fence post to block access to the interior of the fence post and prevent insect infestation, including the creation of nests within the interior of the fence post.

It is a further object of the present invention to provide a fence system including fence posts and rails, wherein the fence post includes an aperture for receiving the rail. The aperture in the fence post for receiving the rail corresponds to the shape or configuration of the cross section of the rail such that the rail fits securely within the fence post without any appreciable gaps or openings that would allow for possible insect infestation within the hollow area of the fence post.

These objects and other features, aspects and advantages of this invention will be more apparent after a reading of the following detailed description, appended claims and accompanying drawings.

DETAILED DESCRIPTION OF THE PREFERRED EMBODIMENT

Figure 4:
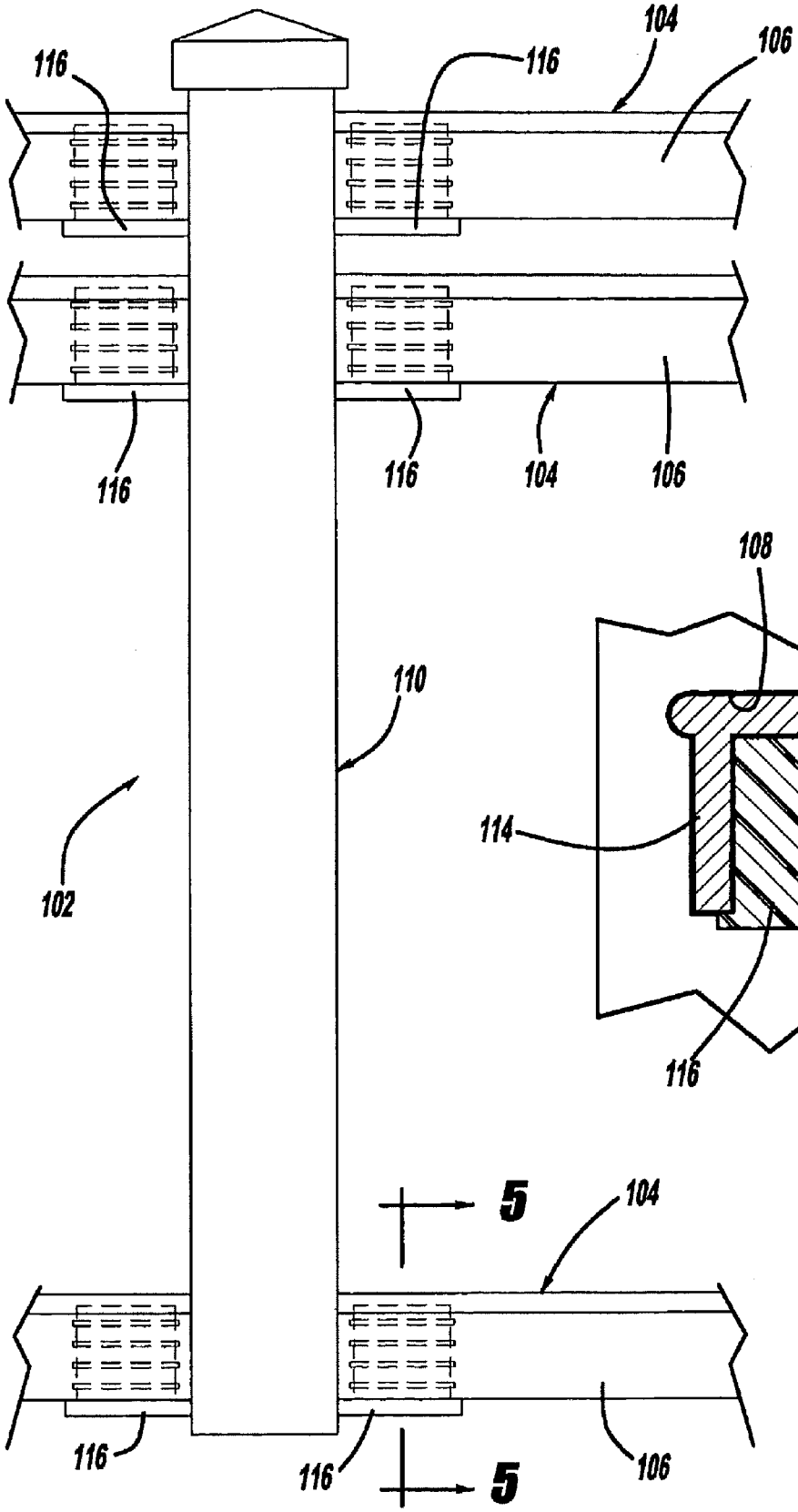
FIG - 4 Prior Art
FIG. 4 is a partial side view of a prior art fence system utilizing a plug placed within the channel of the rail.
Figure 5:
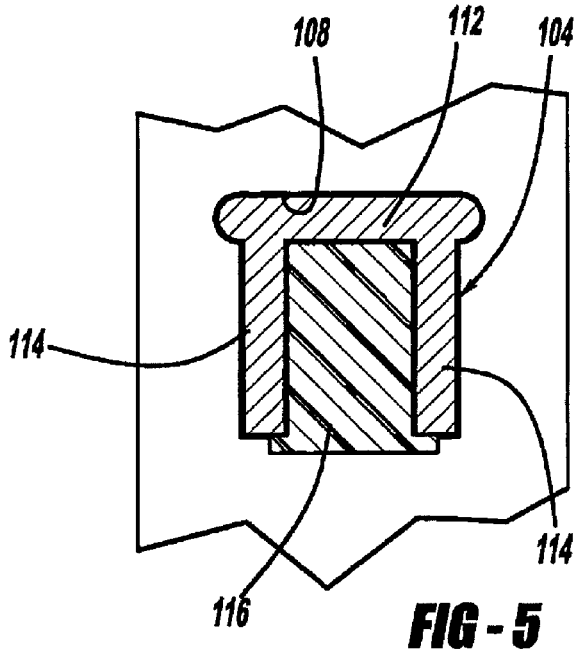
FIG - 5 Prior Art
FIG. 5 is a cross-sectional view of the prior art fence system taken along lines 5-5 of FIG. 4.

As discussed above, FIGS. 4-5 illustrate a prior art fence systems 102 that utilizes a rail 104 having a substantially U-shaped cross section 106. The rail 104 is inserted into an aperture 108 located in a hollow fence post 110. The aperture 108 is typically a rectangular or square opening of a size suitable to accept the three sides of the U-shaped rail 104, specifically, the web 112 and two legs or sides 114 of the U-shaped cross section. Therefore, this type of fence system 102 inherently has a problem in that it provides a gap or opening that allows access to the interior of the fence post 110.

In an attempt to solve this problem, plugs 116 sized to fit between the leg or sides 114 of the U-shaped rail 104 are inserted adjacent the fence post 110. Use of the plug 116, while closing the gap or opening, creates additional costs associated with both manufacturing the plugs 116 and the labor to insert the plugs 116 at each and every joint between the fence post 110 and rail 104. Since this plug is inserted using only an interference fit, it is unknown at this time, whether exposure to the elements, over time, will work its way loose and expose the gap or opening in the rail.

Figure 1:
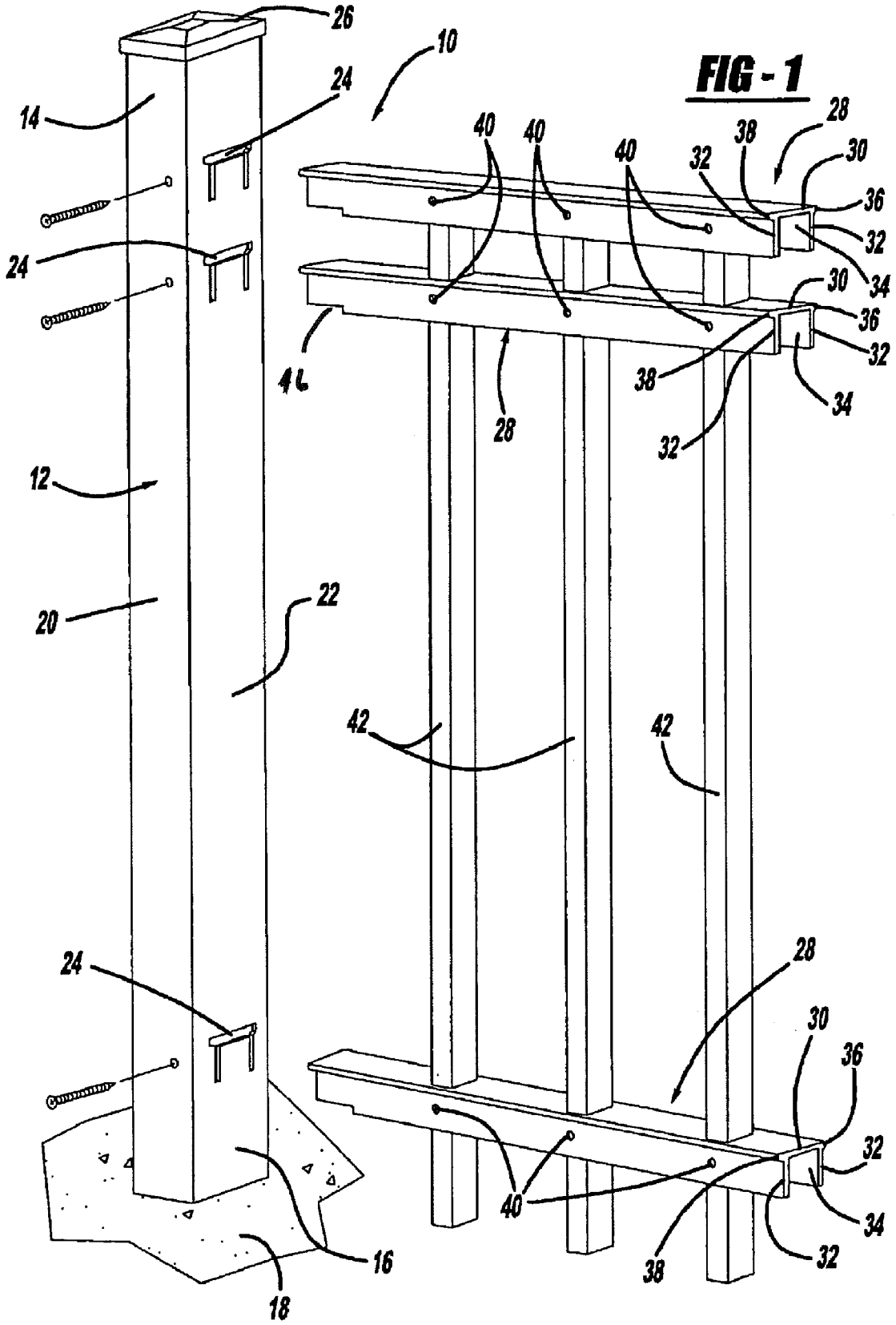
FIG. 1 is an exploded perspective view of a fence system according to the preferred embodiment of the present invention.

Referring now to FIG. 1, there is shown a perspective view of a modular fence system 10 according to an embodiment of the present invention. The modular fence system 10 in includes a fence post 12. The fence post 12 includes an upper end 14 and a lower end 16 that is embedded in the ground 18 using well known prior art teachings for anchoring the post. The fence post 12 is hollow or tubular and includes a front sidewall 20 and a right sidewall 22. It should be understood that the fence post 12 has a cavity and shown in the present invention has a square configuration or cross section and thus includes a rear and left sidewall that is not shown in the drawings. As the fence post 12 is hollow or tubular, each of the front and right sidewalls 20, 22, along with the rear and left sidewalls (not shown) will have interior and exterior surfaces. It should also be understood that although the preferred embodiment describes a square post, other geometric configurations for the post are contemplated in practicing the invention as described herein.

The fence post 12 shown in FIG. 1 is used as an end post and includes three apertures 24 located in the right sidewall 22. If the fence post 12 were to be used as an in-line post it would include additional openings or apertures 24 formed in the left sidewall. If used as a corner post, additional openings or apertures 24 are formed in either the front 20 or rear sidewall depending upon the particular corner formed by the fence post 12. While shown with three openings or apertures 24, the fence post 12 according to the present invention may include a lesser or greater number of openings or apertures 24 depending upon the amount or number of rails 28 forming the fence assembly or system 10. A cap 26 is placed on the upper end 14 of the fence post 12 to cover the upper or open end 14 thereof.

The modular fence system 10 further includes a rail 28. The rail 28 is an elongated substantially U-shaped channel member having an end or web member 30 and side flange members 32 extending substantially perpendicular from the end or web member 30. The side flange members 32 define a gap or opening 34 therebetween. As shown herein, the edges 36, 38 of the end or web member 30 are rounded and extend slightly past the side flange members 32. The rail 28 further includes a plurality of apertures 40 located in the respective side flange members 32.

As shown in FIG. 1 a plurality of fence elements or pickets 42 are fastened to the rails 28. The fence elements or pickets 42 extend up to or through the end or web member 30, and are fastened to the rail 28 by fasteners extending through the apertures 40 located in the side flange members 32 of the rails 28. The rails 28 have a notched portion 46 that provides a stop for the rail 28 as it enters the opening 24 of the post 12. Once the rail 28 is inserted into the opening 24, a seal is created. The number of fence elements or pickets 42 along with the placement or spacing thereof is a design choice. The invention set forth herein is suitable for use with out fence elements or pickets 42 extending between the respective rails 28.

Figure 2:
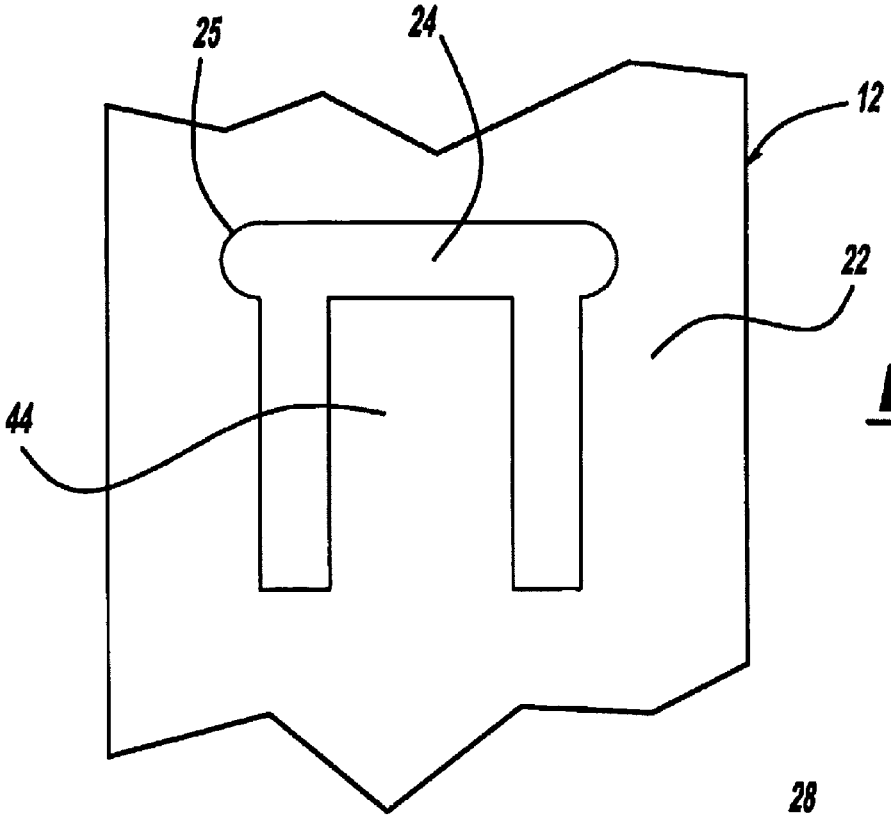
FIG. 2 is a partial side view of the fence post of FIG. 1 illustrating an aperture configured in accordance with the present invention.
Figure 3:
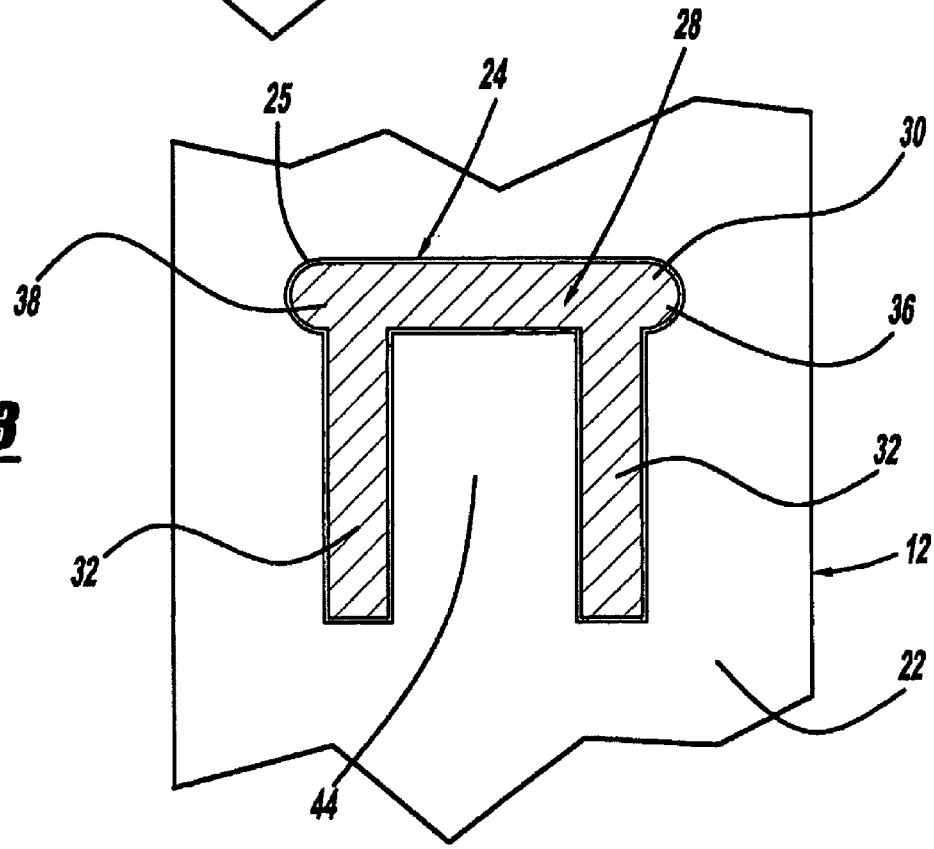
FIG. 3 is a partial, cross-sectional side view of the fence post of FIG. 1 illustrating a rail having a substantially U-shaped cross section disposed within the aperture in accordance with the present invention.

Turning now to FIG. 2 there is shown the aperture or opening 24 in the post in detail. Specifically, an upstanding portion or tab 44 extends upwardly into the aperture or opening 24. The upstanding portion or tab 44 has a shape or configuration complementary to the shape or configuration of the gap or opening 34 located between the respective side flange members 32 of the rail 28. The upstanding portion or tab 44 has a length substantially equal to the length of the respective side flange members 32 such that it ends in close proximity to the end or web member 30 of the rail 28. It will be apparent that the configuration or shape of the opening or aperture 24 is substantially the same as a cross-sectional shape of the inner configuration of the U-shaped channel of the rail 28. Accordingly, as shown in FIG. 3 when the rail 28, shown in cross-section, is inserted into the opening or aperture 24, it fits such that there is no significant gap or opening between the outer periphery of the rail and the inner periphery of the aperture 24 in the post to allow access to the interior of the fence post 12. As shown in FIG. 3, the peripheral edge 25 of the opening or aperture 24 substantially corresponds with the outer configuration of the rail 28 to prevent access and thereby avoid insect infestation within the hollow interior of the fence post 12. The outer configuration, cross-section, or profile of the rail 28 is slightly smaller than the peripheral edge 25 of the aperture 24. No insects can pass between the outer profile of the rail 28 and the aperture 24. This creates a sealed fence system. Insects cannot enter the cavity of the hollow post 12, thus creating an insect-free fence system.

It should be understood that the present invention provides an aperture or opening 24 that substantially corresponds to both the outer configuration or shape of the rail 28 and the inner configuration or shape of the rail 28. That is, the shape of the aperture or opening 24 substantially corresponds to the cross-section of the rail 28. Accordingly, the rail 28 is shown herein as having a substantially U-shaped cross-section with a gap or opening 34 formed by the side flange members 32 of the rail 28. Correspondingly, the aperture or opening 24 of the post 12 includes having an upstanding portion or tab 44 extending upward into the aperture 24. The upstanding portion or tab 44 is sized to fit within the gap or opening 34.

Other configurations, such as a concave polygon shape can be used as long as the aperture or opening 24 has a corresponding concave polygon shape such that any gap existing between the aperture or opening 24 and the rail 28, when the rail 28 is inserted into the post 12 is minimal. Making the gap minimal reduces the opportunity for insects to access the interior of and build nests within the interior of the post 12. For example, if the rail 28 had an L-shape or angle configuration or cross-section, then the opening or aperture 24 should have the same configuration.

According to the present invention, the opening or apertures 24 in the fence post 12 are stamped or cut into the sidewall, shown in FIG. 1 as the right sidewall 22, of the fence post 12 in a configuration corresponding to the particular cross-section of the rail 28. Doing so provides a snug fit between the rail 28 and the fence post 12 while at the same time limiting access to the interior or hollow portion of the fence post 12. Furthermore, the present invention does not require any additional parts or components in the form of plugs or other parts to reduce the possibility of insect infestation within various components of the fence system 10. In addition, the foregoing invention may be used with other components of a fence system 10. For example, depending upon the shape and configuration of the rails, the fence elements or pickets 42 may be installed in the rails in a similar manner.

While the present invention has been described in terms of a preferred embodiment, it is apparent that other forms could be adopted by one skilled in the art. In other words, the teachings of the present invention encompass any reasonable substitutions or equivalents of claim limitations. Accordingly the scope of the present invention is to be limited only by the following claims.

The invention claimed is:

1. A sealed fence comprising:

an elongated tubular post comprising a tubular member having an entirely hollow cavity and at least one aperture in a wall of the post, said aperture defining a generally concave polygonal profile of a predetermined dimension defined by a horizontal slot with a pair of vertical slots extending from the horizontal slot such that the horizontal slot extends past each of the vertical slots at both ends of the horizontal slot;

a plurality of pickets;

a plurality of rail members comprising elongated channel members each having a generally concave polygonal cross-section defined by an elongated horizontal wall and a pair of generally parallel elongated flanges each extending generally perpendicular from the elongated horizontal wall such that the horizontal wall extends past each of the flange members at both ends of the wall, and a portion remote from the horizontal wall portion that is open to define a channel between the flanges, at least one of said rail members having an opening in its elongated horizontal wall for receiving said pickets;

wherein said generally concave polygonal cross-section of the rail corresponds substantially to the generally concave polygonal profile of the aperture in a snug fit such that there is no significant gap between the outer periphery of the rail and the inner periphery of the aperture to allow access to the interior of the fence post by insects;

each rail member having an end portion defining notched portion in the elongated flanges that butts up against the outer surface of said wall of said post to seat the rail against the post in a final assembly position;

and further wherein the wall of the post supports the weight of the rail members and the pickets.

2. The fence as claimed in claim 1, wherein the post and the rail members are sealed so as to preclude insects from entering the cavity of the post.

3. The fence as claimed in claim 1, wherein said pickets extend through at least one rail member.

4. The fence system as claimed in claim 1, wherein the open fence rail member is substantially non-hollow.

5. The fence system as claimed in claim 1, wherein the vertical and horizontal portions of the open fence rail are non-hollow.

6. The fence system as claimed in claim 1, further comprising:

an opening formed in the upper portion of said post; and a cap connected to an upper portion of said post proportioned to close said opening.

* * * * *